US007769333B2

(12) United States Patent
Shin et al.

(10) Patent No.: US 7,769,333 B2
(45) Date of Patent: Aug. 3, 2010

(54) FUSING DEVICE AND IMAGE FORMING APPARATUS HAVING THE SAME

(75) Inventors: Su-ho Shin, Seongnam-si (KR); Tae-hoon Kim, Suwon-si (KR); Dong-woo Lee, Seoul (KR); Tae-gyu Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 11/934,913

(22) Filed: Nov. 5, 2007

(65) Prior Publication Data

US 2008/0304882 A1 Dec. 11, 2008

(30) Foreign Application Priority Data

Jun. 5, 2007 (KR) ..... 10-2007-0055082

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 5,907,348 A * 5/1999 Ogasawara et al. ..... 399/329
6,864,461 B2 * 3/2005 Okabayashi et al. ..... 399/329
2003/0063931 A1 * 4/2003 Sanpei et al. ..... 399/329
2004/0223795 A1 * 11/2004 Ono et al. ..... 399/329
2007/0048035 A1 * 3/2007 Baba et al. ..... 399/323

FOREIGN PATENT DOCUMENTS

JP 10-254270 9/1998
KR 2005-65347 6/2005

OTHER PUBLICATIONS

Korean Office Action dated Apr. 28, 2008 issued in KR 2007-55082.

* cited by examiner

*Primary Examiner*—Stephen D Meier
*Assistant Examiner*—Ruth N Labombard
(74) *Attorney, Agent, or Firm*—Stanzione & Kim, LLP

(57) ABSTRACT

A fusing device includes a pressing member, a belt member to rotate in contact with the pressing member, a nip forming member to support the belt member so that nip areas are formed on the pressing member and the belt member at contacting portions thereto, a heating member disposed away from the nip areas, to heat the belt member, and a tension application member to stiffen the belt member so that the heating member is tightly contacted with the belt member. The heating member includes a plate type heating element which is arranged at an upstream side of the nip areas, and to contact an inner circumference of the belt member, in an advancing direction of the fusing belt. The effective width of then nip areas increases, and the increased pressure is exerted to the nip areas, because the fusing belt enters a location where the nip areas are formed in a heated state. Furthermore, heating efficiency of the fusing belt is increased, because the fusing belt is heated while in a tight contact with the heating member. As a result, fusing performance is enhanced.

24 Claims, 11 Drawing Sheets

FUSING DEVICE AND IMAGE FORMING APPARATUS HAVING THE SAME

CROSS-REFERENCE TO RELATED APPLICATIONS

This application claims priority under 35 U.S.C. §119 (a) from of Korean Patent Application No. 10-2007-0055082, filed on Jun. 5, 2007, in the Korean Intellectual Property Office, the disclosure of which is hereby incorporated herein in its entirety by reference.

BACKGROUND OF THE INVENTION

1. Field of the Invention

The present general inventive concept relates to an image forming apparatus, and more particularly, to a fusing device to fix a developer image onto a recording medium, and an image forming apparatus having the same.

2. Description of the Related Art

Generally, an image forming apparatus such as a printer, a copier, a scanner, a multi-function unit (MFU), or a facsimile, employs a fusing device to fix a developer image onto a recording medium after the developer image is transferred onto the recording medium by a transfer device. The fusing device is mainly classified into roller type and belt type devices.

In compliance with demands for a faster image forming apparatus, a fusing device, which is capable of heating and fusing at a high speed, is required. For faster heating, it is necessary that the heating part have a lower heat capacity. Also for a better fusing performance, a wider nip area and a more effective pressing on a developer image are required so that heat from the heating part can be transmitted to the image more effectively.

However, the currently available roller or belt type fusing device are obstacles to the development of a high speed image forming apparatus, because it does not meet the requirements for fast heating and good fusing performance. The general example of roller and belt type fusing devices will be explained briefly below.

FIG. 1 illustrates a general roller type fusing device. As illustrated, a roller type fusing device includes a pressing roller 10, a heating roller 20 rotated in tight contact with the pressing roller 10, and a heating part 30 disposed inside the heating roller 20.

The roller type fusing device fixes a developer image (T) onto a recording medium (P) by heating and pressing, when the recording medium (P) passes a nip area (N) generated on the pressing roller 10 and the heating roller 20 by a squeezing of the pressing roller 10 and the heating roller 20 against each other. The roller type fusing device has less of a temperature drop, so high speed printing is possible. However, because the heating roller 20 has a high heat capacity and the heating part 30 has to heat the entire heating roller 20, warm-up takes a considerable time. Furthermore, because nip areas (N) are formed as the two rollers 10 and 20 are squeezed against each other, sufficiently wide nip areas (N) cannot be provided. It is also difficult to variably shape the nip areas (N) according to need.

FIG. 2 illustrates a general conventional belt type fusing device. As illustrated, the belt type fusing device includes a pressing roller 10, a fusing belt 40 to rotate with a supply of rotational force being transmitted from the pressing roller 10, a guide member 50 disposed inside the fusing belt 40 to guide the rotation of the fusing belt, and a heating part 60 disposed on the guide member 50 to heat the nip area (N) on the fusing belt 40.

The heating part 60 of the belt type fusing device has a low heat capacity. Because local heating focused on the nip area (N) is possible in the belt type fusing device, a shorter time is required for warm-up than by the roller type fusing device of FIG. 1, and a wider nip area (N) is provided. However, because the heating part 60 is provided at the nip area (N) and pressed by the pressing roller 10, the pressing force of the pressing roller 10 is limited. Accordingly, pressure is not exerted to the nip area (N) effectively, deteriorating the fusing quality. If the pressure at the nip area (N) is increased to improve fusing quality, the heating part 60 may be damaged due to pressure and heat deformation.

SUMMARY OF THE INVENTION

The present general inventive concept provides a fusing device having a nip area separated away from a heating portion, to prevent damage to the heating portion.

The present general inventive concept also provides a fusing device having an increased effective width of a nip area and a reduced warm-up time, to improve fusing quality and printing speed.

The present general inventive concept also provides a fusing device having a heating portion separated away from a nip area, and in which the heating portion is tightly contacted with a fusing belt to increase heating efficiency of the fusing belt.

The present general inventive concept also provides an image forming apparatus having the abovementioned fusing device.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a fusing device including a pressing member, a belt member to rotate in contact with the pressing member, a nip forming member to support the belt member so that nip areas are formed on the pressing member and the belt member at contacting portions thereto, a heating member disposed away from the nip areas, to heat the belt member, and a tension application member to stiffen the belt member so that the heating member is tightly contacted with the belt member.

The pressing member may include a rotatable roller to rotate the belt member.

The belt member may be heated by the heating member before entering to a location where the nip areas are formed. Accordingly, the heating member can be arranged at a upstream side of the nip areas, in an advancing direction of the belt member. The heating member can also be disposed in proximity to an entrance to the location where the nip areas are formed, to minimize heat loss.

The heating member may include a plate type heating element to contact an inner circumference of the belt member. The plate type heating element may include a heater including a heat radiating layer formed on a substrate, and a protective layer to insulate the heat radiating layer, and a heater support to support the heater.

The plate type heating element may include a curved portion to contact the belt member and to facilitate movement of the belt member. A rear side of the substrate of the plate type heating element, opposite to a side where the heat radiating layer is formed, may contact the belt member. The protective layer of the plate type heating element may contact the belt member.

The heater may further include a metal member which is attached to the protective layer, and to contact an inner circumference of the fusing belt.

The plate type heating element may include a temperature sensor to control a temperature of the heater arranged in a space formed between the heater and the heater support.

The fusing device may further include a second temperature sensor to control the temperature at the nip areas housed in the nip forming member.

The nip forming member may include a nip forming surface in one of a crown and an inverse-crown configuration along an axis direction. By doing so, folding or jamming of the recording medium can be prevented.

The nip forming member may include a guide portion or guide portions extending towards an upstream side or/and a downstream side of the nip areas to guide the movement of the belt member.

If the nip forming member includes a guide portion extending towards the upstream side of the nip areas, the heating member may be housed integrally in the guide portion to reduce a number of components and to increase assemblability.

The fusing device may further include a pressing support member to press the nip forming member. The pressing support member helps form uniform nip areas in an axial direction.

The tension application member may include a tension roller to contact an inner circumference of the belt member from a direction opposite to the nip forming member, and an elastic member to support the tension roller elastically in a direction opposite to the nip forming member. The elastic member may include compression coil springs disposed between opposite ends in an axial direction of the tension roller and the pressing support member. The tension application member helps increase contact between the heating member and the belt member, to thus increase heating efficiency of the belt member.

The foregoing and other aspects and utilities of the present general inventive concept may also be achieved by providing a fusing device, including a pressing member, a belt member to rotate in contact with the pressing member, a nip forming member to support the belt member so that nip areas are formed on the pressing member and the belt member at contacting portions thereto, the nip forming member including a nip support portion having a mounting hole, and a nip forming portion received in the mounting hole, a heating member disposed away from the nip areas, to heat the belt member, and a tension application member to stiffen the belt member so that the heating member is tightly contacted with the belt member.

The nip forming portion may be formed of a metal with a greater heat capacity and conductivity per unit volume, compared to the nip support portion. The metal may include stainless steel (SUS) or phosphor bronze. The nip forming portion may include one of a nip plate and a nip spring. The nip forming portion helps minimize temperature differences of the nip areas in n axial direction, and also helps control distribution of pressures exerted to the nip areas. As a result, fusing performance is improved.

The foregoing and other aspects and utilities of the present general inventive concept may also be achieved by providing an image forming apparatus, including a photosensitive medium on which an electrostatic latent image is formed, a developing unit to develop the electrostatic latent image of the photosensitive medium with a developer, a transfer unit to transfer the developer image of the photosensitive medium onto a recording medium, and the abovementioned fusing device to fix the transferred developer image to the recording medium.

The foregoing and other aspects and utilities of the present general inventive concept may also be achieved by providing a fusing device usable with an image forming apparatus including a pressing member, a belt member, a nip forming member disposed within the belt member to for a nip area with the pressing member and the belt member, a tension application member biased away from the nip forming member to apply a tension to the belt member and a heating member disposed to contact the tension-applied belt member to heat the belt member

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
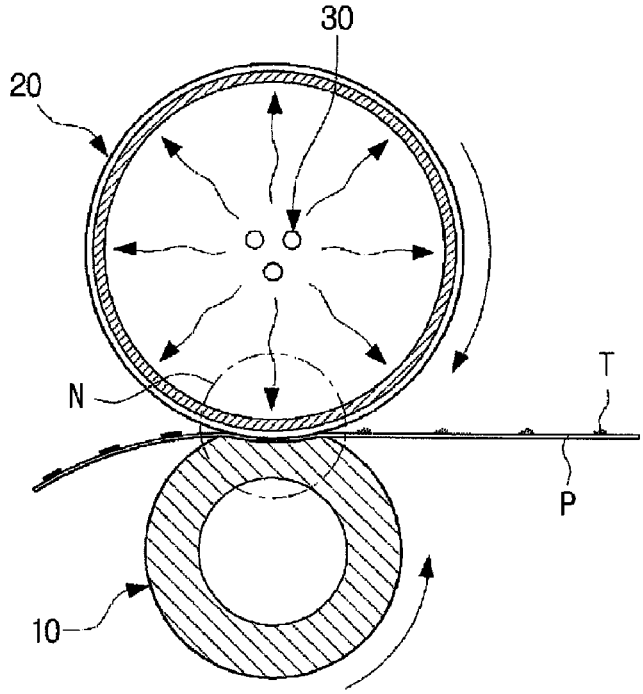
FIG. 1 (PRIOR ART)
FIG. 1 is a cross section view illustrating a conventional roller type fusing device.
Figure 2:
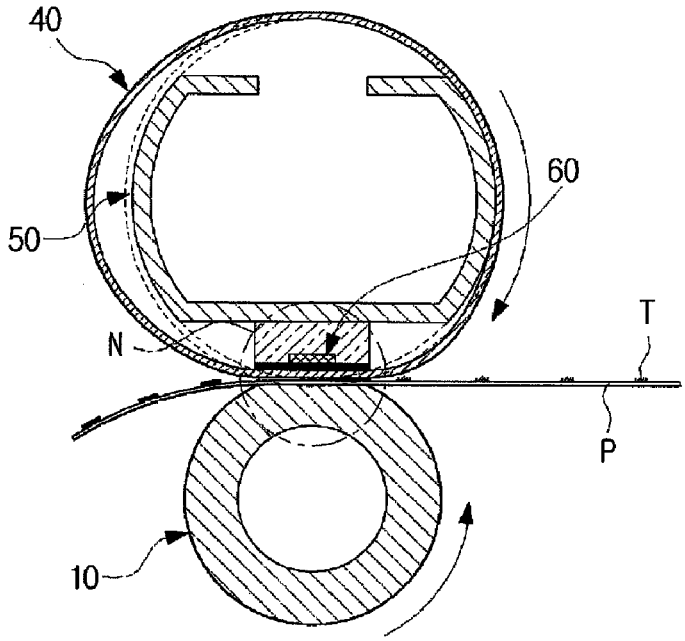
FIG. 2 (PRIOR ART)
FIG. 2 is a cross section view illustrating a conventional belt type fusing device.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIGS. 3 to 6 illustrate a fusing device according to an exemplary embodiment of the present general inventive concept.

Figure 3:
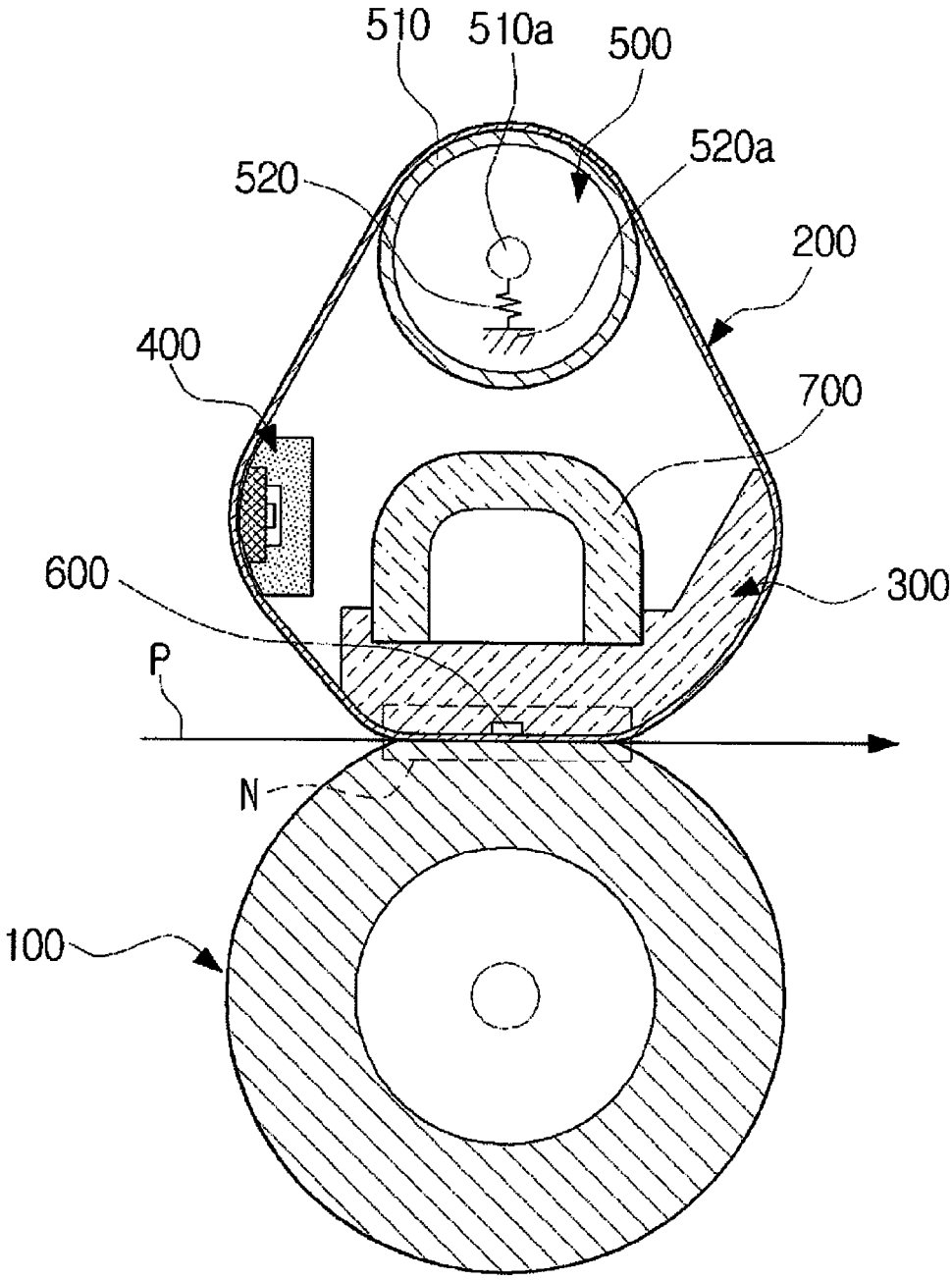
FIG. 3 is a cross section view illustrating a fusing device according to an exemplary embodiment of the present general inventive concept.
Figure 4:
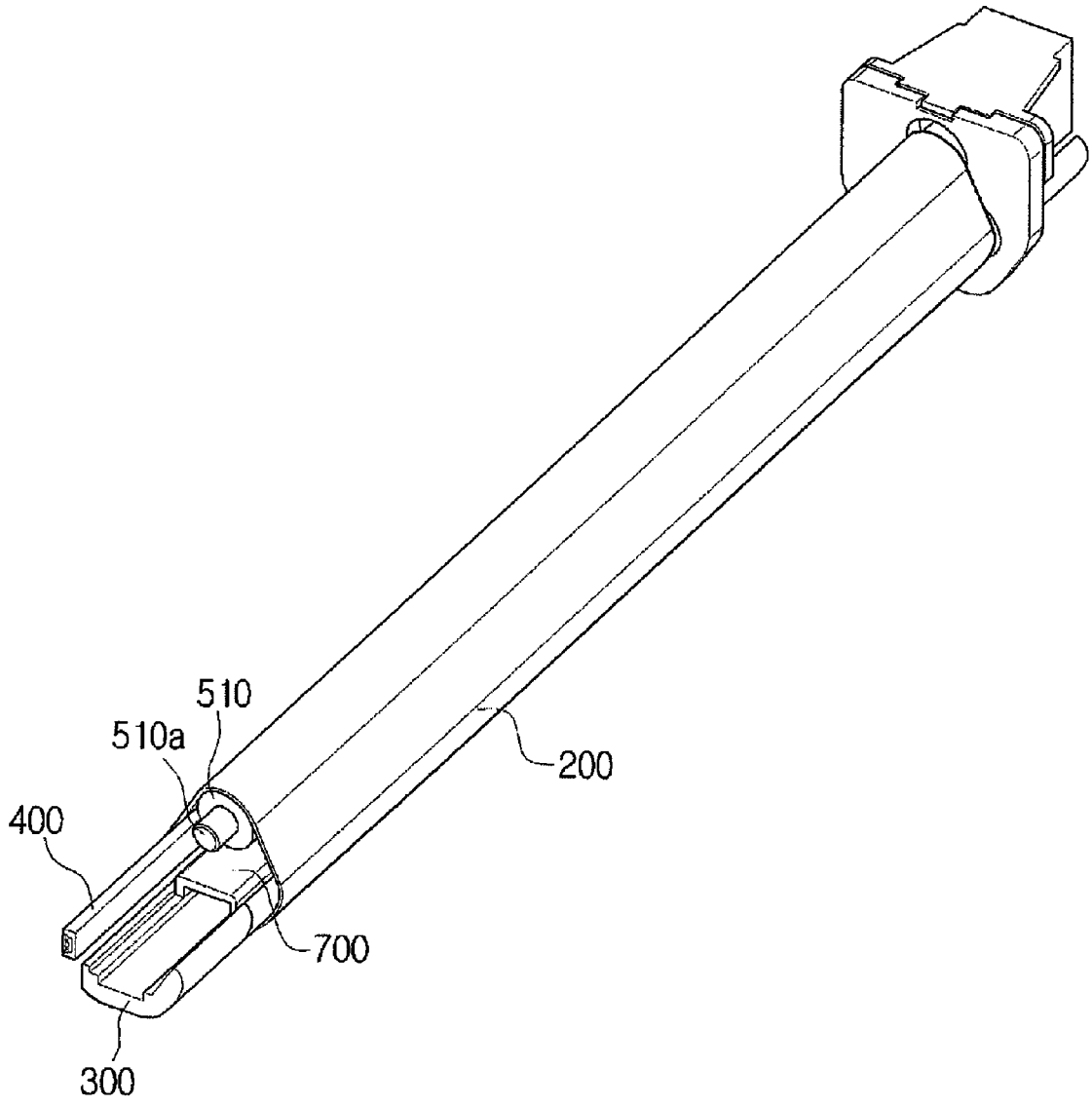
FIG. 4 is a partially-cut perspective view illustrating a fusing belt unit of the fusing device of FIG. 3.

Referring to FIGS. 3 and 4, a fusing device includes a rotatable pressing roller 100, a fusing belt 200 to contact at its outer surface with the pressing roller 100, a nip forming member 300 to support the fusing belt 200 to create nip areas (N) on contact areas of the pressing roller 100 and the fusing belt 200, a heating member 400 distanced away from the nip areas (N) to heat the fusing belt 200, and a tension application member 500 to tighten the fusing belt 200 so that the heating member 400 is squeezed against the fusing belt 200.

The pressing roller 100 may be formed as an elongated cylinder to form a nip area (N) in cooperation with the fusing belt 200, and to squeeze a recording medium (P) against the fusing belt 200. However, the pressing roller 100 is only an example of the pressing member. Alternatively, a belt type or a pad type member may be employed as the pressing member. The roll type pressing member as incorporated in the present example embodiment prevents slippage during a conveyance of a recording medium (P). An elastic member (not illustrated) may be provided between a rotational axis of the pressing roller 100 and a frame of the fusing device, to elastically support the pressing roller 100 towards the fusing belt 200.

The fusing belt 200 is one example of a belt member according to the example embodiment of the present general inventive concept, which receives rotational force from the pressing roller 100 to rotatably run. The fusing belt 200 has a width corresponding to a length of the pressing roller 100, and may be made from a heat-resistant material. When employed in a monochromatic image forming apparatus, the fusing belt 200 may have a single layer structure made from metal or heat-resistant polymer. The metal may be SUS or nickel, and the heat-resistant polymer may be polyimide. Alternatively, the fusing belt 200 may have a multi-layer structure. For example, the fusing belt 200 may have a multi-layer structure including a resilient layer made from silicone or rubber to deal with color printing. The multi-layer structure may include an abrasion-resistant layer formed on an inner and/or outer circumference by Teflon resin coating. Additionally, a lubricant may be applied on an inner surface of the fusing belt 200 to allow the fusing belt 200 to run smoothly.

The fusing belt 200 has a predetermined tension to allow for a smooth rotation. A predetermined degree of pressure is exerted between the pressing roller 100 and the fusing belt 200, for the fusing of developer image being transferred onto a recording medium (P). The example embodiment explained below exemplifies a structure in which the fusing belt 200 is passive-rotated by the pressing roller. Alternatively, a separate driving device may be provided to drive the fusing belt 200. Alternatively, the structure may be provided, in which the fusing belt 200 is rotated, and the pressing roller 100 is passive-rotated by the rotation of the fusing belt 200.

The nip forming member 300 supports the fusing belt 200 so that nip areas (N) are formed on the pressing roller 100 and the fusing belt 200 contacting each other. The nip forming member 300 has a length that corresponds to a width of the fusing belt 200. The nip forming member 300 is formed opposite to the pressing roller 100, with the fusing belt 200 being interposed therebetween. Accordingly, the nip forming member 300 contacts an inner circumference of the fusing belt 200. The nip forming member 300 may be made from a heat insulating material having low heat conductivity, to minimize heat loss of the fusing belt 200 due to the nip forming member 300. For example, the nip forming member 300 may be made from polyetheretherketone (PEEK) or liquid crystal polymer (LCP).

Figure 5A:
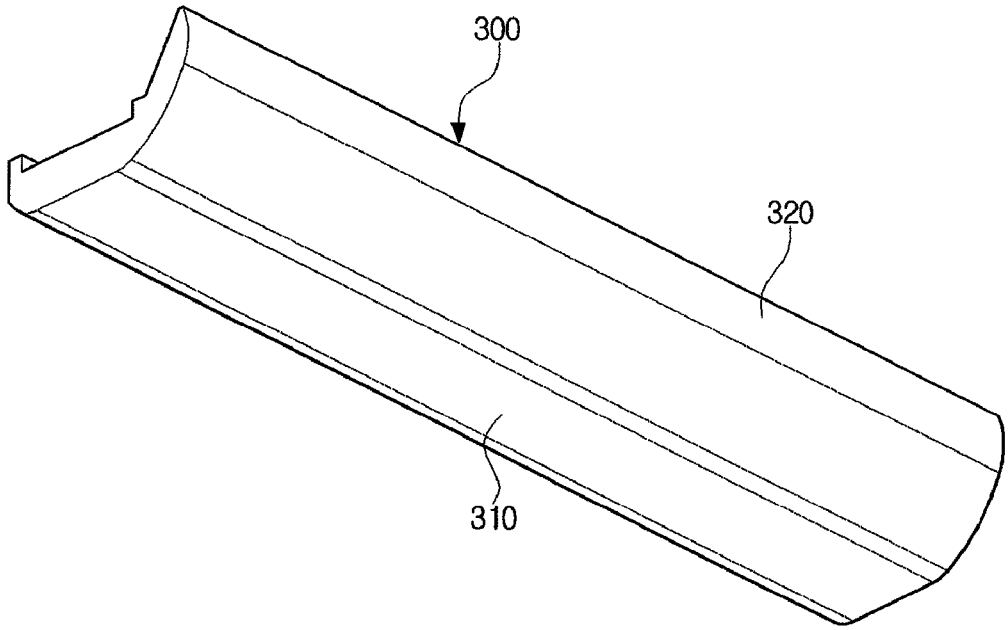
FIG. 5A is a perspective view illustrating a nip forming member of the fusing belt unit of FIG. 4.
Figure 5B:
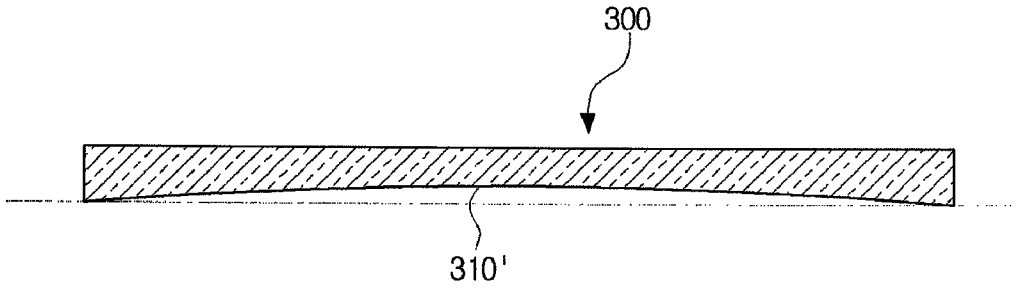
FIGS. 5B and 5C are cross section views illustrating a nip forming member having a nip forming surface in a crown and an inverse-crown configurations.
Figure 5C:
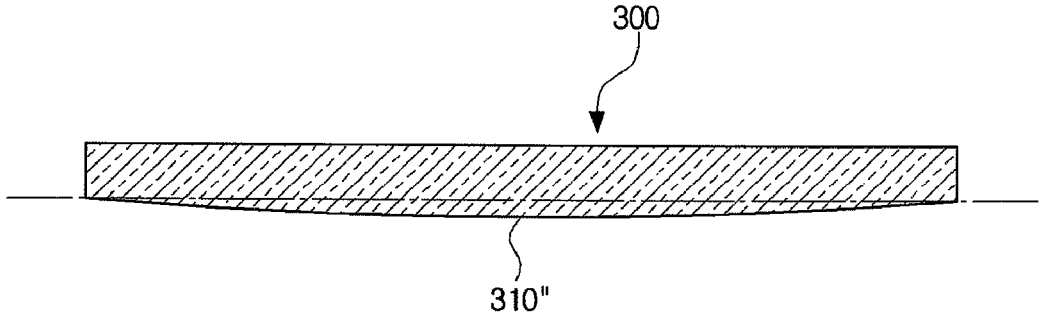

Referring to FIG. 5A, the nip forming member 300 includes a nip forming surface 310 which is almost planar in an axial direction. Alternatively, referring to FIGS. 5B and 5C, the nip forming member 300 may have a crown or inverse-crown shaped nip forming surfaces 310' and 310". The crown shaped nip forming surface 310' gradually curves in as illustrated in FIG. 5B, and the inverse-crown shaped nip forming surface 310" gradually curves out as illustrated in FIG. 5C. Due to the crown or inverse-crown shaped nip forming surfaces 310' and 310", folding or jamming of the recording medium (P) can be avoided.

The nip forming member 300 may include a guide portion 320 extending towards a downstream side of the nip areas (N) to guide a smooth running of the fusing belt 200. Although not illustrated, the guide portion may extend towards an upstream side of the nip areas (N), or towards both the upstream and downstream sides. An example embodiment employing guide portion extending both towards the upstream and downstream sides will be explained below.

Referring to FIGS. 3 and 4, the heating member 400 has a length that corresponds to a width of the fusing belt 200. The heating member 400 is elongated along the width direction of the fusing belt 200. Additionally, the heating member 400 may be arranged at an upstream side of the nip areas (N) in an advancing direction of the fusing belt 200 to locally heat the fusing belt 200. As the fusing belt 200 passes through the heating member 400, a temperature of the heated portion of the fusing belt 200 rises to above a developer fusing temperature. The heated portion of the fusing belt 200 then reaches the nip areas (N). Because the fusing belt 200 is tightened by the tension application member 500 during heating of the heating member 400, the heating member 400 is squeezed against the fusing belt 200, thereby increasing heating efficiency. The heating member 400 can be arranged in proximity to an entry side of the nip areas (N) to minimize heat loss during the running of the fusing belt 200.

Figure 6A:
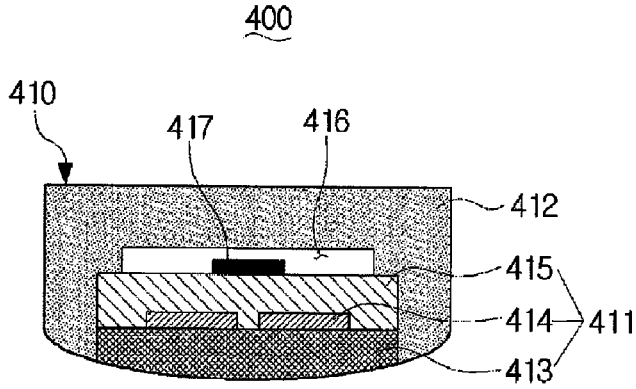
FIGS. 6A to 6C are views illustrating examples of a heating member applicable to the fusing device of FIG. 3.
Figure 6B:
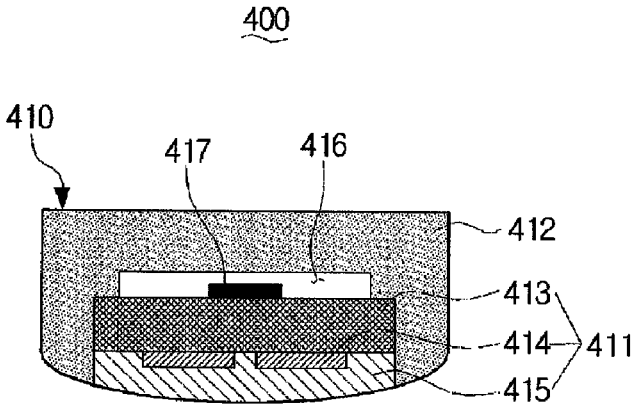
Figure 6C:
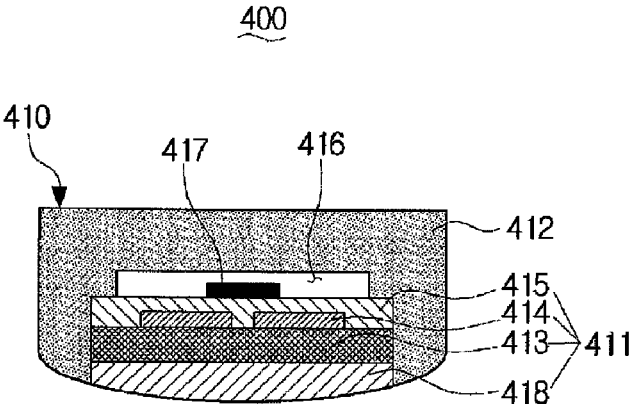

Referring to FIGS. 6A and 6B, the heating member 400 includes a plate type heating element 410 formed to contact the inner circumference of the fusing belt 200 (FIG. 3). The plate type heating element 410 includes a heater 411 to generate heat upon a power-on condition, and a heater support 412 to support the heater 411. The heater 411 includes a heat radiating layer 414 patterned on a substrate 413, and a protective layer 415 to provide insulation to the heat radiating layer 414.

The substrate 413 may be an alumina (Al2O3) substrate or an aluminum nitride (AlN) substrate. The heat radiating layer 414 may be formed by patterning a material of high electric resistivity into the substrate 413. The material of high electric resistivity includes Ag—Pd group or Ta—Al. The heater support 412 may be made from a heat insulating material having a low heat conductivity, so that the heat of the heater 411 can be focused on the fusing belt 200. For example, the heater support 412 may be made from heat-resistant polymer such as PEEK, or LCP.

The plate type heating element 410 may have a curved surface at an area that contacts the fusing belt 200 in consideration of a path of the fusing belt 200 (FIG. 3), to enable smooth running of the fusing belt 200. For example, the area of the plate type heating element 410 that contacts the fusing belt 200 may be a rear side of the substrate 413 where the heat radiating layer 414 is not formed (see FIG. 6A), or may be the protective layer 415 (see FIG. 6B). The rear side of the substrate 413, or the protective layer 415 may be processed into a curved surface to enable smooth running of the fusing belt 200. For example, the rear side of the substrate 413 or the protective layer 415 may be grinded. The rear side of the substrate 413 may be processed to a curved surface in advance, before the heat radiating layer 414 is formed. Alternatively, an outer surface of the protective layer 415 may be formed to a curved surface by metal molding in a formation stage of the protective layer 415. Alternatively, a metal member 418 having a curved surface may be inserted in the plate type heating element 410 to contact the fusing belt 200. The metal member 418 having the curved surface may be a material of high heat conductivity, such as copper, aluminum, or an alloy thereof.

The plate type heating element 410 includes a space 416 formed between the heater 411 surface and the heater support 412 not contacting the fusing belt 200 to reduce the contact area between the heater 411 and the heater support 412 and to minimize heat loss due to thermal conduction. A first temperature sensor 417 may be provided in the space 416 to control the temperature of the heater 411.

The heating member 400 may be implemented as not only the plate type heating element 410, but also a lamp heater or an electro-thermal wire.

Referring to FIG. 3, the tension application member 500 may include a tension roller 510 to contact the inner circumference of the fusing belt 200 at a position opposite to the heat forming member 300, and an elastic member 520 to elastically support the tension roller 510 opposite to the nip forming member 300.

The tension roller 510 may be implemented as an elongated cylindrical configuration that has a length corresponding to the width of the fusing belt 200. The tension roller 510 may be a hollow pipe of a small thickness. The elastic member 520 may be implemented as a compression coil spring disposed between a shaft 510*a* and a support 520*a* of the tension roller 510. The support 520*a* may be a portion of the fusing device frame, or a pressing support member 700 which will be explained below. By a returning force of the compression coil spring, tension is exerted to the fusing belt 200 so that the fusing belt 200 remains in a stiff state. As a result, contact between the heating member 400 and the fusing belt 200 increases, and the fusing belt 200 is heated effectively.

Referring to FIG. 3, the fusing device according to an exemplary embodiment of the present general inventive concept may include a second temperature sensor 600 to control temperature of the nip areas (N). The second temperature sensor 600 may be housed in the nip forming member 300.

Additionally, the fusing device according to the present embodiment of the present general inventive concept may include the pressing support member 700 to press the nip forming member 300 and to form uniform nip areas (N) in a width direction of the recording medium (P), that is, in a length direction of the nip forming member 300 which is perpendicular to an advancing direction of the fusing belt 200. The pressing support member 700 may be made from a metal such as SUS, and may be formed in an arch configuration to increase a strength of the structure. The pressing support member 700 prevents movement and deformation of the nip forming member 300 elongated along the width direction of the recording medium (P) so as to maintain uniform nip areas (N). Both ends of the pressing support member 700 are supported on the frame (not illustrated) of the fusing device.

In the fusing device constructed as explained above according to the present embodiment of the present general inventive concept, a developer image is fixed into the recording medium (P) by heat and pressure, when the recording medium (P) passes through the nip areas (N) formed by squeezing the pressing roller 100 against the fusing belt 200. At this time, the pressing roller 100, which is opposite to the nip forming member 300, presses the nip area (N) of the fusing belt 200, and the heating member 400, which is squeezed against the stiffened fusing belt 200 by the tension application member 500, heats the fusing belt 200 from the upstream side of the nip area (N). That is, because the heating member 400 is separated away from the nip areas (N), the nip areas (N) can be squeezed under high pressure, while an area at the heating member 400 is squeezed under relatively low pressure that is strong enough only to heat the fusing belt 200. Because the pressure is limited within the degree that can enable the heating member 400 to heat the fusing belt 200, damage to the heating member 400 due to pressure can be avoided. Furthermore, because the heating member 400 is arranged away from the nip areas (N), pressure at the nip areas (N) can be increased freely to increase an effective width of the nip areas (N). If the effective width of the nip areas (N) increases, the recording medium (P) going through the nip areas (N) is pressed for a longer period of time, so that enhanced and efficient fusing is enabled.

Figure 7:
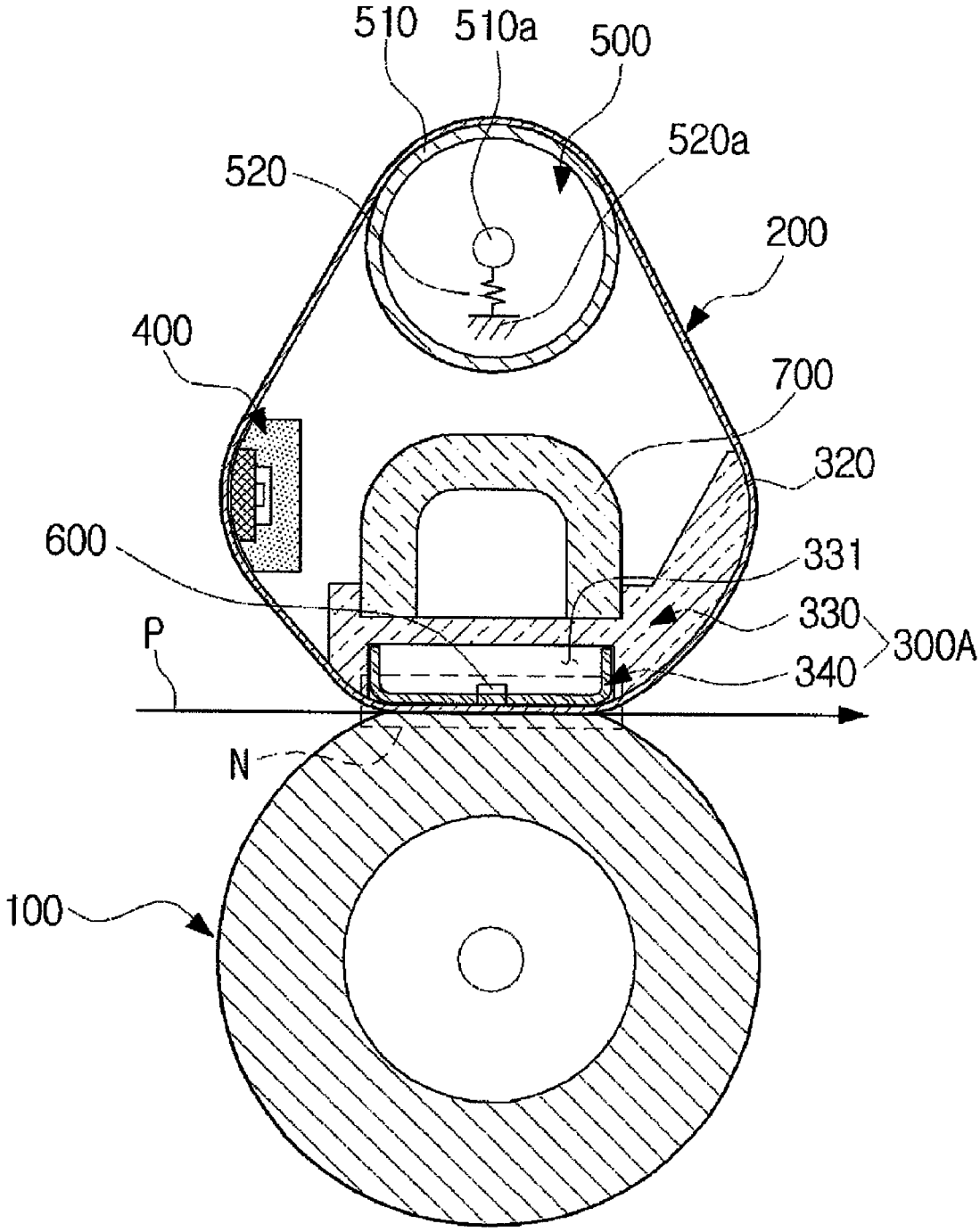
FIG. 7 is a cross section view illustrating a fusing device according to another exemplary embodiment of the present general inventive concept.

FIG. 7 is a cross section view illustrating a fusing device according to another exemplary embodiment of the present general inventive concept. Referring to FIG. 7, the fusing device of the present embodiment is almost identical to the embodiment illustrated in FIG. 3, except for the nip forming member 300A which is differently formed from that of the embodiment illustrated in FIG. 3. Throughout the description set forth below, the like elements will be referred to by the same reference numerals, and these will not be explained in detail for the sake of brevity.

The nip forming member 300A includes a nip support portion 330 and a nip forming portion 340. The nip support portion 330 includes an insertion hole 331 extended along the length direction, so that the nip forming portion 340 is inserted in an insertion hole 331 to complete the nip forming member 300A. The nip forming portion 340 may be an inverse-arch shaped nip plate. Although not illustrated, the nip forming portion 340 may be implemented as a planar element. The nip support portion 330 may be made from the same heat insulating material as the nip forming member 300 of the embodiment as illustrated in FIG. 3. However, the nip forming portion 340 may be made from a metal such as SUS or phosphor bronze that has a higher heat capacity per unit volume and a higher thermal conductivity than the nip support portion 330. Although not illustrated, the nip forming portion 340 may include crown or inverse-crown shaped nip forming surface.

The nip forming portion 340 helps maintain the temperature in the axial direction of the nip areas (N) at uniform degrees, by the heat conduction in the length direction. Accordingly, even when a non-standard recording medium such as a narrow envelope is used, a temperature difference between the nip contacting and non-contacting portions of the recording medium can be minimized. Because the heat of the nip areas (N) that do not contact the recording medium is easily conducted to the nip areas (N) that contact the recording medium via the nip forming portion 340, a temperature difference between the nip contacting and non-contacting portions is almost negligible. Furthermore, because the nip forming portion 340 serves as a thermal reservoir, a temperature change does not occur even when a plurality of recording media is fed consecutively.

Figure 8:
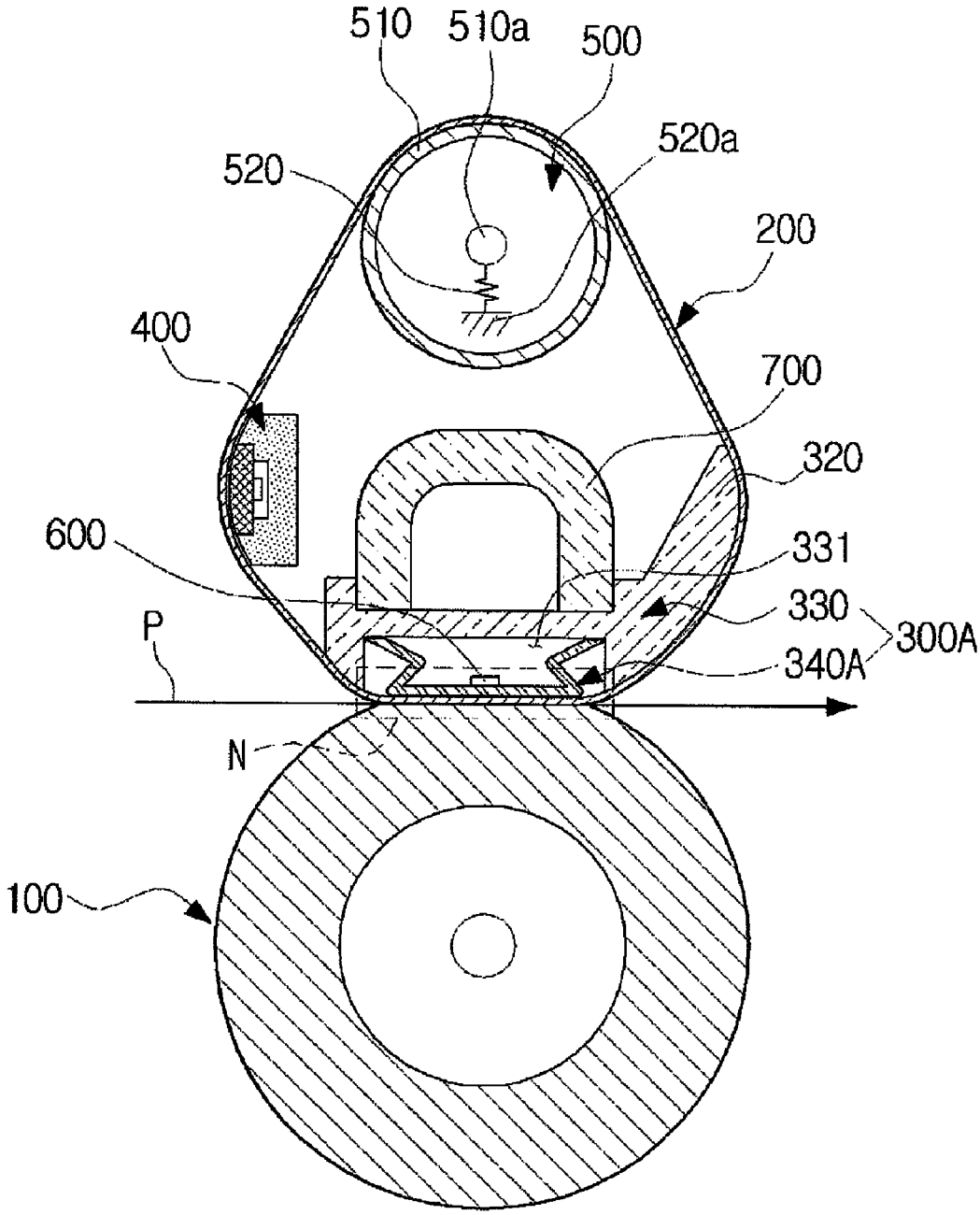
FIG. 8 is a cross section view illustrating a fusing device according to another exemplary embodiment of the present general inventive concept.

While basic functions and effects of the fusing device according to the exemplary embodiment as illustrated in FIG. 8 are almost same as those of the embodiment as illustrated in FIG. 3, the present embodiment provides additional effects of providing stable temperature to the nip areas (N).

FIG. 8 is a cross section view illustrating a fusing device according to another exemplary embodiment of the present general inventive concept. Referring to FIG. 8, the fusing device has almost the same structure as that of the embodiment as illustrated in FIG. 7, except for a nip spring that is substituting for the nip forming portion 340A. Throughout the description set forth below, the like elements will be referred to by the same reference numerals, and these will not be explained in detail for the sake of brevity.

By use of the nip spring for the nip forming portion 340A, the fusing device according to the embodiment as illustrated in FIG. 7 can provide further improved fusing performance, because it can provide not only the thermal effect by the nip plate as in the second embodiment, but also the controlled pressure distribution over the nip areas (N) by the nip spring.

Figure 9:
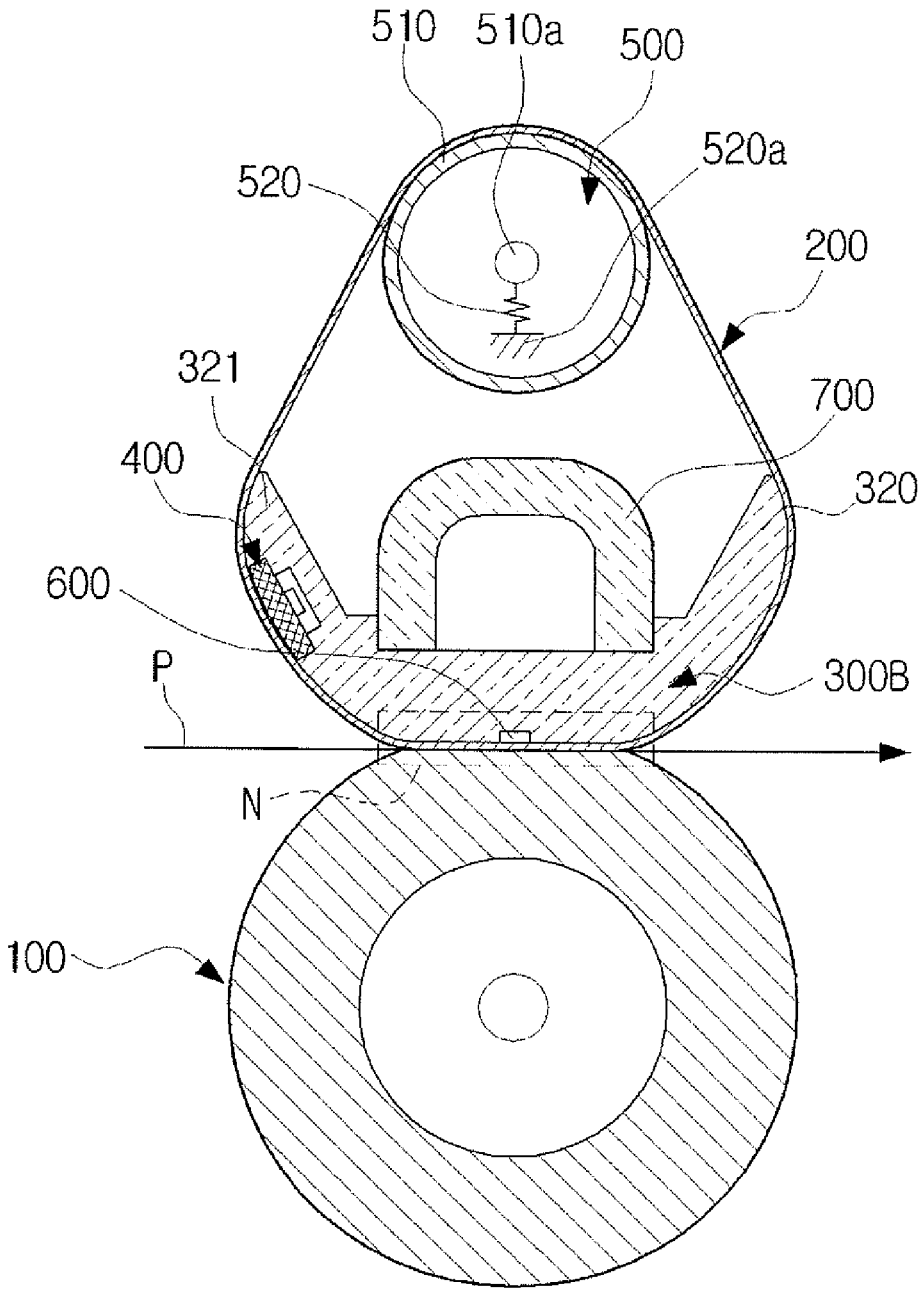
FIG. 9 is a cross section view illustrating a fusing device according to another exemplary embodiment of the present general inventive concept.

FIG. 9 is a cross section view illustrating a fusing device according to another exemplary embodiment of the present general inventive concept. Referring to FIG. 9, the fusing device has almost the same structure as that of the embodiment as illustrated in FIG. 3, except for a heating member 400 which is formed integrally with a nip forming member 300B. Throughout the description set forth below, the like elements will be referred to by the same reference numerals, and these will not be explained in detail for the sake of brevity.

The nip forming member 300B includes first and second guide portions 321 and 320 extending towards upstream and downstream sides of the nip areas (N) to guide the fusing belt 200. The heating member 400 is formed integrally within the first guide portion 321. In particular, the first guide portion 321 includes a groove extending along a length direction, and the heating member 400 is inserted in the groove.

The present example embodiment of the present general inventive concept provides advantages such as a requirement for a fewer number of parts and a simpler assembling process. A fewer number of parts are required because the heating member 500 is formed integrally with the nip forming member 300B, and it is easy to assemble because both the heating member 400 and the nip forming member 300B are supported by the pressing support member 700. The present embodiment also provides basic functions and effects as explained in the embodiment as illustrated in FIG. 3.

Figure 10:
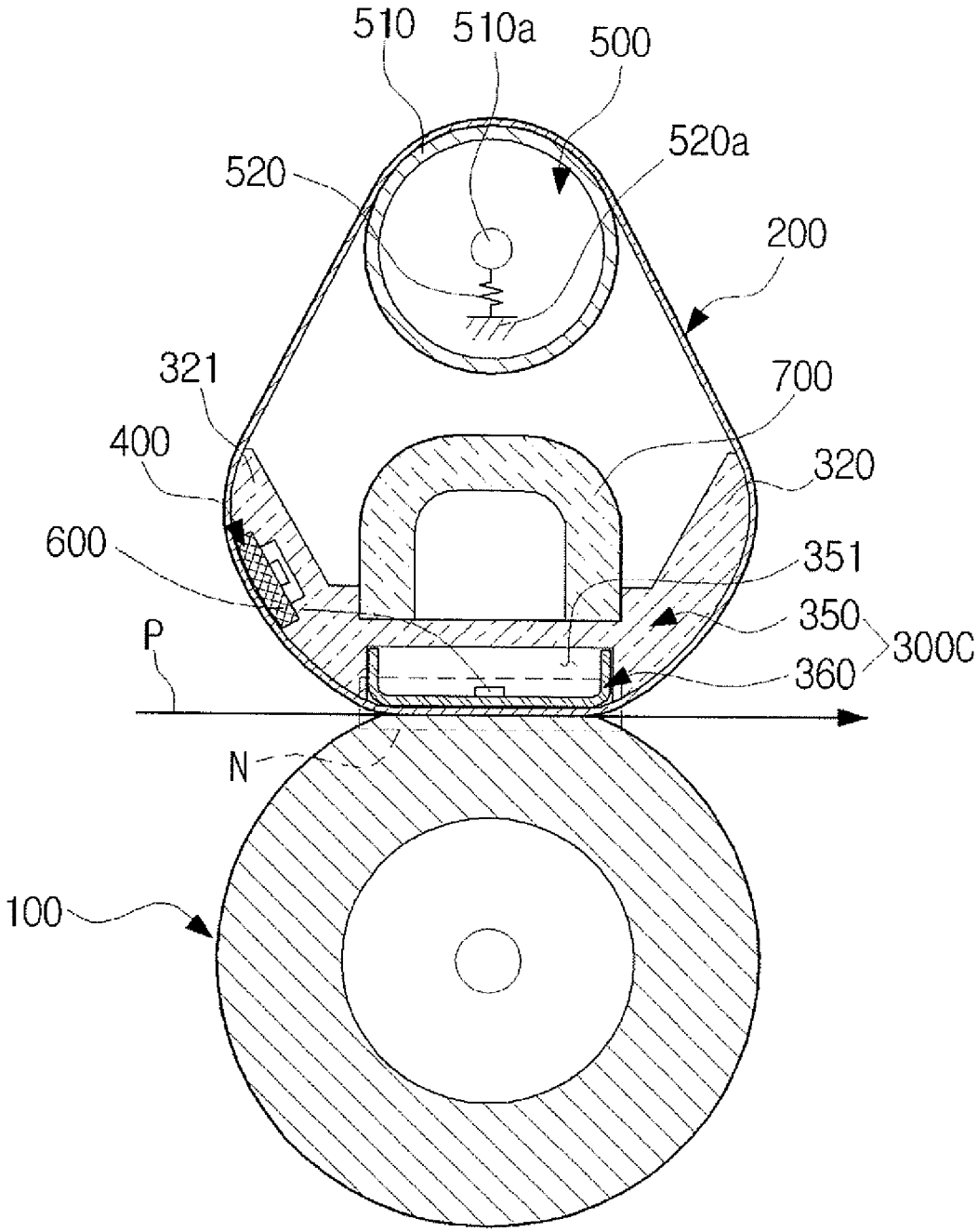
FIG. 10 is a cross section view illustrating a fusing device according to another exemplary embodiment of the present general inventive concept.

FIG. 10 is a cross section view illustrating a fusing device according to another exemplary embodiment of the present general inventive concept. Referring to FIG. 10, the fusing device has almost the same structure as that of the embodiment illustrated in FIG. 9, except for a nip forming member 300C which is formed differently from that of the fourth embodiment. Throughout the description set forth below, the like elements will be referred to by the same reference numerals, and these will not be explained in detail for the sake of brevity.

The nip forming member 300C according to the present embodiment of the present general inventive concept includes a nip support portion 350 and a nip forming portion 360. The nip support portion 350 includes a mount space 351, and first and second guide portions 321 and 320 extending towards the upstream and downstream sides of the nip areas (N) to guide the fusing belt 200. The nip forming portion 360 is received in the mount space 351 so that the nip forming member 300C is completed. The nip forming portion 360 has the same structure and effects as that of the embodiment illustrated in FIG. 7. Therefore, detailed explanation will be omitted for the sake of brevity.

The present embodiment of the present general inventive concept provides the effects of the embodiment illustrated in FIG. 9 and the embodiment illustrated in FIG. 7, including easy assembling and considerable enhancement of fusing performance.

Figure 11:
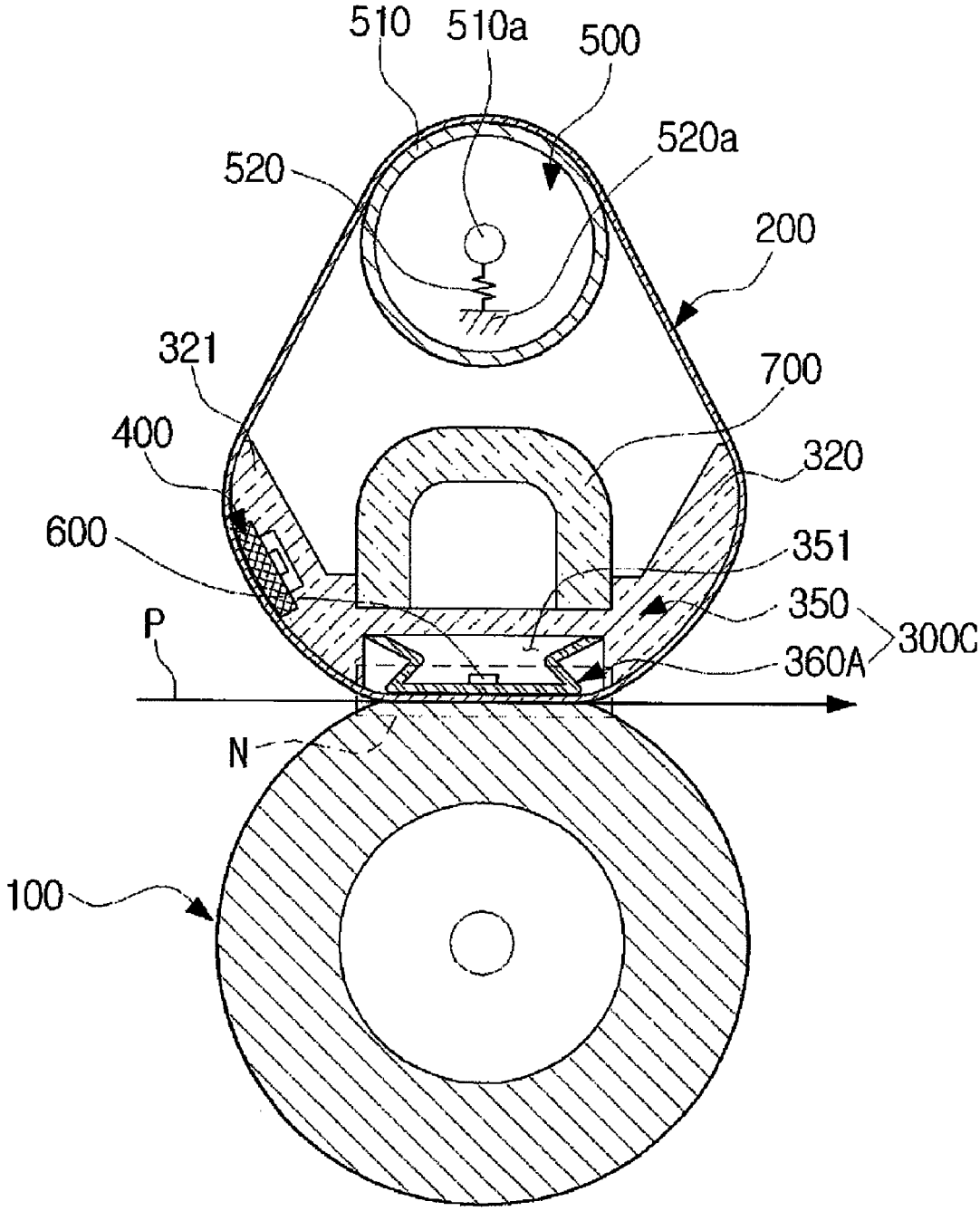
FIG. 11 is a cross section view illustrating a fusing device according to another exemplary embodiment of the present general inventive concept.

FIG. 11 is a cross section view illustrating a fusing device according to another embodiment of the present general inventive concept. Referring to FIG. 11, the fusing device has almost the same structure as that of the embodiment illustrated in FIG. 10, except for a nip spring that is substituting for the nip forming portion 360A. Throughout the description set forth below, the like elements will be referred to by the same reference numerals, and these will not be explained in detail for the sake of brevity.

By use of nip spring for the nip forming portion 360A, the fusing device according to the present embodiment can provide further improved fusing performance, because it can provide not only the thermal effect by the nip plate as in the embodiment as illustrated in FIG. 10, but also the controlled pressure distribution over the nip areas (N) by the nip spring.

Figure 12:
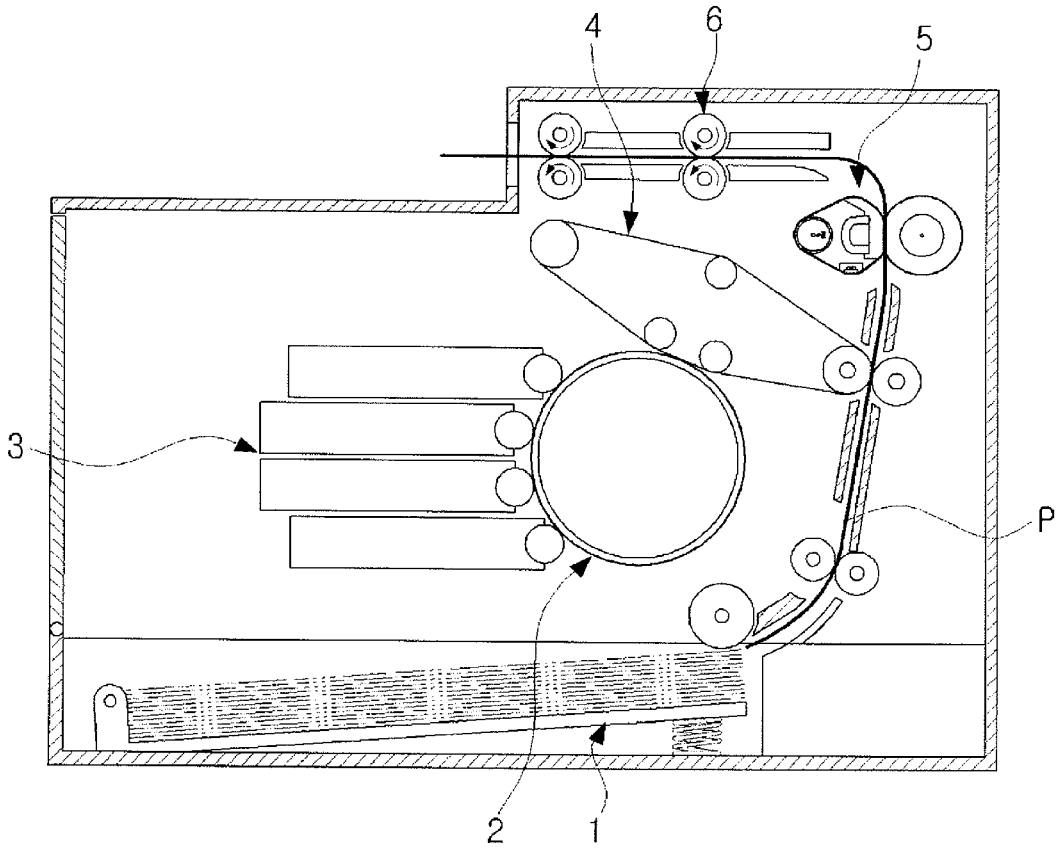
FIG. 12 is a view illustrating an image forming apparatus employing a fusing device according to another exemplary embodiment of the present general inventive concept.

FIG. 12 illustrates an image forming apparatus employing the fusing device according to the embodiment as illustrated in FIG. 3. Referring to FIG. 12, the image forming apparatus includes a feeding device 1, a photosensitive medium 2 to form an electrostatic latent image thereon, a developing device 3 to visualize the electrostatic latent image by use of a developer, a transfer device 4 to transfer the developer image of the photosensitive medium 2 onto a recording medium (P), a fusing device 5 to fix the transferred developer image into the recording medium (P), and a discharge device 6.

Because the feeding device 1, the photosensitive medium 2, the developing device 3, the transfer device 4, and the discharge device 6 have known structures and functions, these will not be explained in detail below for the sake of brevity. The fusing device 5 has the characteristics illustrated in and explained with reference to the embodiments as illustrated in FIGS. 3 to 11. As a result, the image forming apparatus employing the fusing device can provide high speed operation and customer satisfaction.

Although FIG. 12 illustrates an image forming apparatus having the fusing device according to the embodiment as illustrated in FIG. 3, the image forming apparatus may of course employ fusing devices illustrated in any one of the embodiments illustrated in FIGS. 7 to 11.

As explained above, according to various embodiments of the present general inventive concepts, by distancing the heating member 400 away from the nip areas (N) where the developer image is pressed and heated, the heating member 400 is not subjected to the pressure of the nip areas (N) and as a result, prevented from being damaged. Specifically, because the heating member 400 is positioned at the upstream side of the nip areas (N) in the advancing direction of the fusing belt 200, the fusing pressure does not affect the heating member 400 when the fusing belt 200, being heated to a developer fusing temperature by the heating member 400, reaches the nip areas (N). Furthermore, the heating efficiency of the fusing belt 200 is improved, because the fusing belt 200 is heated in a complete contact with the heating member 400 in a stiffened state by the tension application member 500. Again, because the heating member 400 is subjected to far less pressure than at the nip areas (N), damage to the heating member 400 can be avoided.

According to various embodiments of the present general inventive concept, the heating member 400 has a low heat capacity, because the heating member 400 heats the fusing belt 200 locally, at a distance away from the nip areas (N). As a result, a warm-up time is reduced. In particular, the warm-up time is reduced because the heat radiating member 400 has a lower heat capacity, by use of a thin plate type heating element having a substrate and a heating layer patterned on the substrate, and heat of the heater is focused on the heating of the fusing belt 200 because an insulating material is arranged at a side opposite to the contact side with the fusing belt 200.

According to various embodiments of the present general inventive concept, the pressing portion can be designed in various ways, without being limited by the configuration of the heating member, because the heating member 400 is distanced away from the nip areas (N). As a result, an effective width of the nip areas (N) is increased, a pressing force is increased, fusing performance is enhanced, and printing is done stably even at a high speed.

Furthermore, according to various embodiments of the present general inventive concept, fusing performance is enhanced by use of a nip plate or nip spring at the nip areas (N). That is, a temperature difference in the width direction of the recording medium is reduced, and the distribution of a pressing force over the nip areas (N) is controlled through adjustments of recovering characteristics of the nip spring.

In an exemplary embodiment where the heating member is housed integrally within the nip forming member, the structure to support the pressing and heating members at the nip areas (N) is simplified.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A fusing device usable with an image forming apparatus, the fusing device comprising:

a pressing member;

a belt member to rotate in contact with the pressing member;

a nip forming member to support the belt member so that nip areas are formed on the pressing member and the belt member at contacting portions thereto;

a heating member disposed away from the nip areas, to heat the belt member; and a tension application member to stiffen the belt member so that the heating member is tightly contacted with the belt member, the tension application member comprises:

a tension roller to contact an inner circumference of the belt member from a direction opposite to the nip forming member; and an elastic member to support the tension roller elastically in a direction opposite to the nip forming member, wherein the nip forming member has a non-round shape, has a nip forming surface which is substantially plane along an axial direction corresponding to the nip areas, and does not rotate.

2. The fusing device of claim 1, wherein the pressing member comprises:

a rotatable roller to rotate the belt member.

3. The fusing device of claim 1, wherein:

the belt member is heated by the heating member before entering to a location where the nip areas are formed; and the heating member is arranged at an upstream side of the nip areas, in an advancing direction of the belt member.

4. The fusing device of claim 3, wherein the heating member is disposed in proximity to an entrance to the location where the nip areas are formed.

5. The fusing device of claim 1, wherein the heating member comprises:

a plate type heating element to contact an inner circumference of the belt member.

6. The fusing device of claim 5, wherein the plate type heating element comprises:

a heater including a heat radiating layer formed on a substrate;

a protective layer to insulate the heat radiating layer; and a heater support to support the heater.

7. The fusing device of claim 6, wherein the plate type heating element comprises:

a curved portion to contact the belt member.

8. The fusing device of claim 7, wherein a rear side of the substrate of the plate type heating element, opposite to a side where the heat radiating layer is formed, contacts the belt member.

9. The fusing device of claim 7, wherein the protective layer of the plate type heating element contacts the belt member.

10. The fusing device of claim 6, further comprising:

a metal member which is attached to the protective layer, and includes a curved side contacting an inner circumference of the belt member.

11. The fusing device of claim 6, wherein the plate type heating element comprises:

a first temperature sensor to control a temperature of the heater arranged in a space formed between the heater and the heater support; and a second temperature sensor to control the temperature at the nip areas housed in the nip forming member.

12. The fusing device of claim 1, wherein the nip forming member comprises:

a nip forming surface in one of an inverse-crown configuration and a crown configuration along an axial direction.

13. The fusing device of claim 1, wherein the nip forming member comprises:

a guide portion extending towards an upstream or a downstream side of the nip areas to guide the belt member.

14. The fusing device of claim 1, wherein the nip forming member comprises:

first and second guide portions extending towards upstream and downstream sides of the nip areas to guide the belt member.

15. The fusing device of claim 14, wherein the heating member is housed integrally in the first guide portion of the nip forming member.

16. The fusing device of claim 1, further comprising:

a pressing support member to press the nip forming member.

17. The fusing device of claim 1, wherein the elastic member comprises:

compression coil springs disposed between opposite ends in an axial direction of the tension roller and the pressing support member.

18. The fusing device of claim 1, wherein the nip forming member comprises:

a nip support portion having a mounting hole; and a nip forming portion received in the mounting hole.

19. The fusing device of claim 18, wherein the nip forming portion is formed of a metal with a greater heat capacity and conductivity per unit volume, compared to the nip support portion.

20. The fusing device of claim 19, wherein the metal comprises a stainless steel (SUS) or phosphor bronze.

21. The fusing device of claim 19, wherein the nip forming portion comprises:

one of a nip plate and a nip spring.

22. An image forming apparatus, comprising:

a photosensitive medium on which an electrostatic latent image is formed;

a developing unit to develop the electrostatic latent image of the photosensitive medium with a developer;

a transfer unit to transfer the developer image of the photosensitive medium onto a recording medium; and a fusing device to fix the transferred developer image to the recording medium, the fusing device comprising:

a pressing member;

a belt member to rotate in contact with the pressing member;

a nip forming member to support the belt member so that nip areas are formed on the pressing member and the belt member at contacting portions thereto;

a heating member disposed away from the nip areas, to heat the belt member; and a tension application member to stiffen the belt member so that the heating member is tightly contacted with the belt member, the tension application member comprises:

a tension roller to contact an inner circumference of the belt member from a direction opposite to the nip forming member; and an elastic member to support the tension roller elastically in a direction opposite to the nip forming member, wherein the nip forming member has a non-round shape, has a nip forming surface which is substantially plane along an axial direction corresponding to the nip areas, and does not rotate.

23. The image forming apparatus of claim 22, wherein the nip forming member includes:

a nip support having a mounting hole; and a nip forming portion received in the mounting hole.

24. A fusing device usable with an image forming apparatus, comprising:

a pressing member;

a belt member;

a nip forming member disposed within the belt member to form a nip area with the pressing member and the belt member;

a tension application member biased away from the nip forming member to apply a tension to the belt member, the tension application member comprises;

a tension roller to contact an inner circumference of the belt member from a direction opposite to the nip forming member; and an elastic member to support the tension roller elastically in a direction opposite to the nip forming member; and a heating member disposed to contact the tension-applied belt member to heat the belt member, wherein the nip forming member has a non-round shape, has a nip forming surface which is substantially plane along an axial direction corresponding to the nip areas, and does not rotate.

* * * * *